US005555650A

United States Patent [19]

Longbottom et al.

[11] Patent Number: 5,555,650

[45] Date of Patent: Sep. 17, 1996

[54] LACELESS ATHLETIC SHOE

[76] Inventors: Mark A. Longbottom, 15 Thackeray Grove, Lockwood, Huddersfield, England, HD4 5HD; Simon J. Peel, 5 Meadow Bank, Holnfirth, Huddersfield, England, HD7 1YS

[21] Appl. No.: 250,546

[22] Filed: May 27, 1994

[51] Int. Cl.[6] ..... A43B 5/00

[52] U.S. Cl. ..... 36/114; 36/133; 36/128; 36/50.1; 36/45

[58] Field of Search ..... 36/114, 133, 128, 36/129, 105, 106, 50.1, 45, 107, 32 R

[56] References Cited

U.S. PATENT DOCUMENTS

| | | | |
|---|---|---|---|
| 955,337 | 4/1910 | Lawlor | 36/105 |
| 1,701,611 | 2/1929 | Gudden et al. | 36/32 R |
| 1,704,187 | 3/1929 | Glidden et al. | 36/32 R |
| 4,481,726 | 11/1984 | Phillips | 36/30 R |
| 4,546,559 | 10/1985 | Dassler | 36/114 |
| 4,559,723 | 12/1985 | Hamy et al. | 36/114 |
| 4,624,062 | 11/1986 | Autry | 36/114 |
| 4,811,497 | 3/1989 | Merino Ciudad | 36/128 |
| 5,052,130 | 10/1991 | Barry et al. | 36/114 |
| 5,070,629 | 12/1991 | Graham et al. | 36/27 |
| 5,109,613 | 5/1992 | Van Dyke | 36/89 |
| 5,319,869 | 6/1994 | McDonald et al. | 36/114 |

FOREIGN PATENT DOCUMENTS

| | | | |
|---|---|---|---|
| 0184996 | 6/1986 | European Pat. Off. | 36/128 |
| 928996 | 6/1955 | Germany | 36/128 |
| 3706069 | 9/1988 | Germany | 36/133 |
| 3837504 | 5/1990 | Germany | 36/133 |
| 1618372 | 1/1991 | U.S.S.R. | 36/133 |

OTHER PUBLICATIONS

WO91/009547, Jul. 1991, PCT, Collins, 36/107.

Front and rear covers and pages 12–13 of Reebok world Soccer Update presenting feature entitled "Footwear for 2002" (four pages; copyright 1993).

*Primary Examiner*—Paul T. Sewell
*Assistant Examiner*—Marie Denise Patterson
*Attorney, Agent, or Firm*—Dean W. Russell; Kilpatrick & Cody

[57] ABSTRACT

A laceless athletic shoe is disclosed. The shoe presents a thin, uniform upper surface, permitting truer kicks when contacted by a soccer or other ball. An integral elastic area in the upper expands to receive the wearer's foot, while carbon fibers embedded in and grooves formed across the outsole provide greater torsional stability and flexibility of the shoe during turns.

1 Claim, 2 Drawing Sheets

LACELESS ATHLETIC SHOE

FIELD OF THE INVENTION

This invention relates to an athletic shoe and more particularly to a laceless, cleated soccer or other shoe.

SUMMARY OF THE INVENTION

Conventional athletic shoes typically include laces, which function to secure each shoe about the foot of a wearer. To protect the dorsal surface of the foot from the laces, these shoes also include a tongue. The combination of laces and tongue results in a relatively bulky, discontinuous upper, however, which inhibits uniform contact between the foot and, for example, a soccer or other ball.

The present invention provides an alternative athletic shoe lacking both laces and a tongue. The laceless upper presents a thinner, more uniform contact surface than do conventional athletic shoes, providing truer kicks for soccer players and other wearers of the shoe. The upper also includes an integral, elastic area that expands to receive the wearer's foot and contracts to conform to the wearer's ankle thereafter. Combined with a cinching system positioned across the top of the foot, this elastic area secures the shoe of the present invention about the wearer's foot.

Carbon fibers embedded in and anatomically-contoured grooves formed across the outsole improve the responsiveness of the shoe in use. The fibers, woven and coated with urethane, supply torsional stability along the length of the forefoot, while the grooves provide greater flexibility when the wearer turns. The molded outsole additionally strengthens the shoe along its length and furnishes the substantially flat heel and arch surfaces preferred by many soccer players.

It is therefore an object of the present invention to provide a laceless athletic shoe.

It is also an object of the present invention to provide a shoe presenting a relatively thin, uniform contact surface for truer kicking of balls and other objects.

It is another object of the present invention to provide a shoe having an elastic area in the upper for receiving and securing the wearer's foot.

It is yet another object of the present invention to provide a shoe having carbon fibers embedded in and anatomically-contoured grooves formed across the outsole.

Other objects, features, and advantages of the present invention will become apparent with reference to the remainder of the written portion and the drawings of this application.

DETAILED DESCRIPTION

Figure 1:
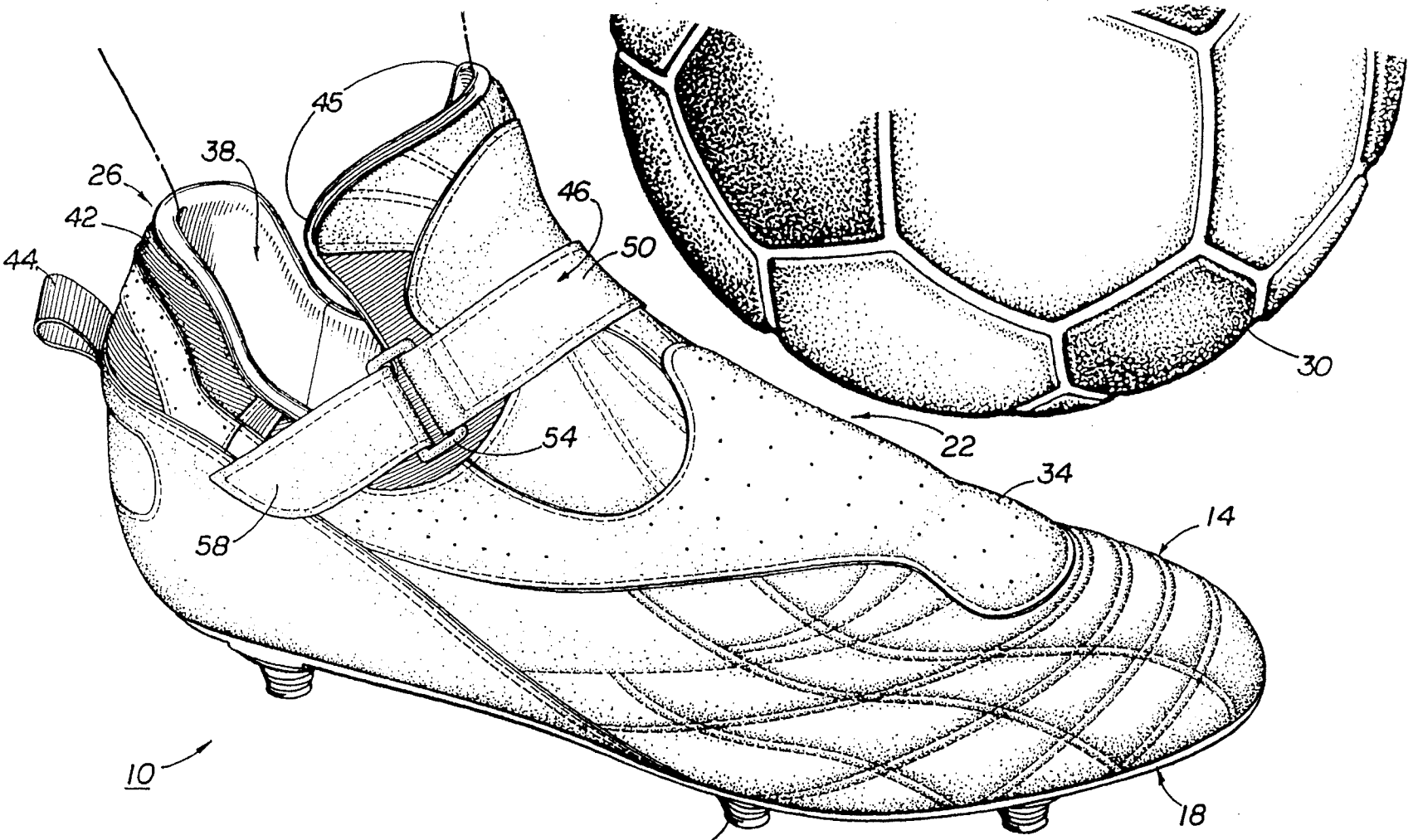
FIG. 1 is a perspective view primarily of the upper of a shoe of the present invention.
Figure 2:
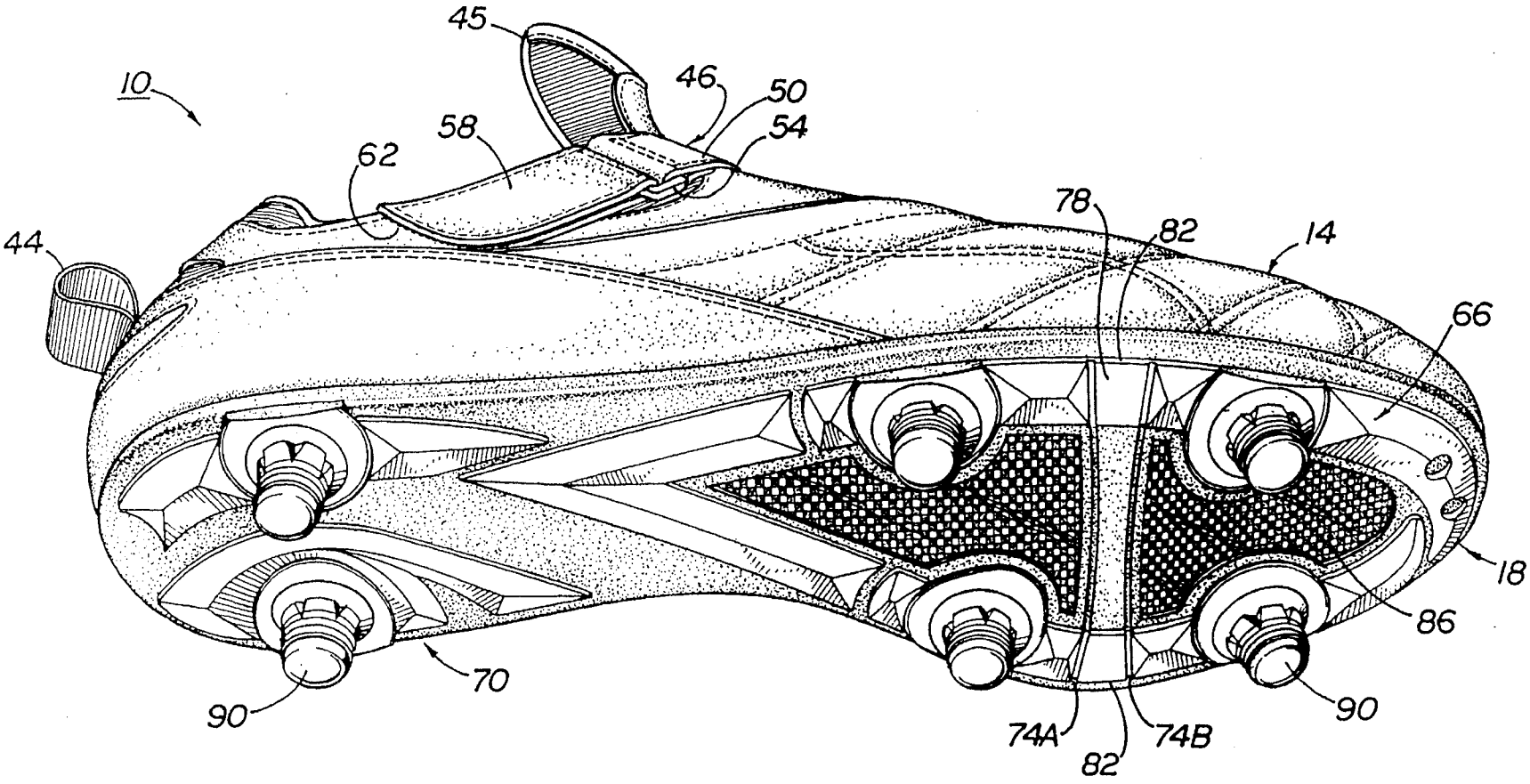
FIG. 2 is a perspective view primarily of the outsole of the shoe of FIG. 1.

FIGS. 1–2 illustrate shoe 10 of the present invention. Shoe 10 is formed of upper 14 and outsole 18, which may be adhered or otherwise connected using conventional methods. Upper 14, typically made of leather, includes first (dorsal) segment 22, designed to be adjacent the dorsal portion of the wearer's foot when worn, and second (ankle) segment 26 intended to surround the wearer's ankle. Although as described herein segments 22 and 26 have functional aspects, other aspects of shoe 10 are ornamental and included for aesthetic purposes.

Unlike conventional athletic shoes, shoe 10 is not secured about the wearer's foot with laces. Instead, shoe 10 receives and conforms to the foot without laces, analogous to the action of a sock or stocking. Lacking laces, shoe 10 additionally requires no separate tongue, permitting an integral segment 22 to extend across the dorsal surface of the wearer's foot. As a result, segment 22 presents a thin, uniform surface for contacting items such as soccer ball 30, thereby providing truer kicks for soccer players and other wearers of shoe 10. A separate cushion 34 may be sewn onto or otherwise adhered to segment 22 if desired, although it too (if present) is designed to provide a relatively uniform contact surface as part of shoe 10.

Second segment 26 defines an opening 38 for receiving the wearer's foot. Surrounding the wearer's ankle is an elastic area 42 typically made of neoprene and lycra, designed to expand to receive the wearer's foot and thereafter contract to conform to the wearer is ankle. The result is a shoe 10 capable of fitting securely about the wearer's foot, notwithstanding omission of both laces and a tongue. Segment 26 additionally includes loop 44 at the wearer's heel, through which the wearer may place a finger for pulling shoe 10 about his foot. Protruding portions 45 opposite opening 38 from loop 44 are also intended to be grasped by the thumbs and forefinger of the wearer to align opening 38 with the wearer's foot.

Cinching system 46 enhances the fitting of shoe 10. As shown in FIG. 1, system 46 includes a leather or other strap 50 positioned across upper 14 above (dorsal) segment 22. Buckle 54 connects strap 50 to a generally inelastic strap 58 (also possibly of leather), the underside of which includes hooks designed to engage loops attached to upper 14. Using system 46, therefore, a wearer may extend strap 54 until it is taut and retain strap 54 in the extended position by merely pulling strap 58 and engaging the hook-and-loop fastener 62.

Outsole 18 of shoe 10 is detailed in FIG. 2. Made of rigid molded plastic, outsole 18 includes fore and rear sections 66 and 70, respectively. Separating these sections are dual grooves 74A and 74B, which span outsole 18 laterally and define a flexible region 78. As illustrated in FIG. 2, grooves 74A and 74B flare at the edges 82 of outsole 18, so as not to restrict the flexibility of the outsole 18 when the wearer turns.

By contrast, embedded in outsole 18 are materials 86 for restricting directional flexibility of the outsole 18. In some embodiments of shoe 10, materials 86 comprise woven carbon fibers coated with urethane. Like grooves 74A and 74B, materials 86 flex laterally. As woven, however, materials 86 do not flex longitudinally, thereby providing torsional stability along fore section 66 of shoe 10. If desired for improved traction, cleats 90 may protrude from outsole 18.

The foregoing is provided for purposes of illustrating, explaining, and describing embodiments of the present invention. Modifications and adaptations to these embodiments will be apparent to those of ordinary skill in the art and may be made without departing from the scope or spirit of the invention.

We claim:

1. An athletic shoe having a toe region for use by a wearer having an ankle region and a foot with a transverse tarsal joint, comprising:

a. an upper lacking laces and a tongue but comprising:

i. a continuous, essentially inexpansible, cushioned dorsal segment extending from the toe region to the portion of the upper approximately above the transverse tarsal joint of the wearer's foot;

ii. an ankle segment integrally formed with the dorsal segment, defining an opening for receiving a wearer's foot, and comprising an elastic area surrounding the opening;

iii. means, comprising a loop attached to the ankle segment, for temporarily receiving the wearer's finger; and iv. a system for cinching the shoe about the wearer's foot, comprising:

A. a buckle;

B. a first strap spanning the upper above the dorsal segment and attached to the buckle; and C. means, comprising a second strap connected to the buckle, for attaching the first strap to the upper; and b. an outsole comprising:

i. a fore section of rigid plastic;

ii. a rear section of rigid plastic;

iii. at least one groove laterally spanning the outsole and separating the fore and rear sections; and iv. means, comprising woven carbon fibers coated with urethane and embedded in the fore section of the outsole, for providing torsional stability to the shoe.

* * * * *